United States Patent [19]

Uematsu

[11] Patent Number: 4,626,619

[45] Date of Patent: Dec. 2, 1986

[54] WATER IMPERVIOUS RUBBER OR PLASTIC INSULATED POWER CABLE

[75] Inventor: Tadayuki Uematsu, Chiba, Japan

[73] Assignee: The Furukawa Electric Co., Ltd., Tokyo, Japan

[21] Appl. No.: 799,189

[22] Filed: Nov. 18, 1985

Related U.S. Application Data

[63] Continuation of Ser. No. 651,644, Sep. 17, 1984, which is a continuation of Ser. No. 468,402, Feb. 22, 1983, abandoned.

[30] Foreign Application Priority Data

Feb. 7, 1983 [JP] Japan ..... 58-15372[U]

[51] Int. Cl.[4] ..... H01B 7/18

[52] U.S. Cl. ..... 174/106 SC; 174/106 R

[58] Field of Search ..... 174/106 R, 106 SC, 107

[56] References Cited

U.S. PATENT DOCUMENTS

| | | | |
|---|---|---|---|
| 2,948,772 | 8/1960 | Bopp | 174/107 |
| 4,020,276 | 4/1977 | Maingueneau | 174/107 |
| 4,042,776 | 8/1977 | Matsuba et al. | 174/107 X |
| 4,145,567 | 3/1979 | Bahder et al. | 174/107 |
| 4,256,921 | 3/1981 | Bahder | 174/107 |
| 4,472,597 | 9/1984 | Uematsu | 174/106 SC |
| 4,501,928 | 2/1985 | Ishitobi | 174/107 |

FOREIGN PATENT DOCUMENTS

| | | | |
|---|---|---|---|
| 63378 | 4/1945 | Denmark | 174/107 |
| 2508928 | 9/1976 | Fed. Rep. of Germany | 174/107 |
| 7709329 | 6/1978 | Fed. Rep. of Germany . | |
| 2807767 | 8/1979 | Fed. Rep. of Germany | 174/107 |
| 2832529 | 2/1980 | Fed. Rep. of Germany | 174/106 R |
| 57-69110 | 4/1982 | Japan . | |
| 58-311 | 1/1983 | Japan . | |
| 1375677 | 11/1974 | United Kingdom | 174/107 |

OTHER PUBLICATIONS

The Institute of Electrical Engineers of Japan, "Development of Water Impervious Cable", pp. 49–58, Feb. 15, 1982, Uchiyama et al.

Proceedings of the 52nd Annual Convention of the Wire Associate International, pp. 44–50, Oct. 1982, "Development of Waterproof XLPE Cable".

*Primary Examiner*—Arthur T. Grimley

*Assistant Examiner*—Morris H. Nimmo

*Attorney, Agent, or Firm*—Frishauf, Holtz, Goodman & Woodward

[57] ABSTRACT

A rubber or plastic insulated power cable having water impervious layers on the center conductor and cable insulation core. The layers completely prevent water infiltration into the insulation for a long time period and eliminate dielectric deterioration of the insulation by water trees.

14 Claims, 5 Drawing Figures

WATER IMPERVIOUS RUBBER OR PLASTIC INSULATED POWER CABLE

This application is a continuation of Ser. No 651,644, filed Sept. 17, 1984, which is a continuation of application Ser. No. 468,402, filed Feb. 22, 1983, now abandoned.

BACKGROUND OF THE INVENTION

The present invention relates to an improvement in a rubber or plastic insulated power cable.

A power cable insulated with rubber or plastics to withstand high voltages of 3,300 V or more has a basic structure as shown in FIG. 1. Referring to FIG. 1, a conductor shield 2, an insulation layer 3 of polyethylene, crosslinked polyethylene, ethylene-propylene rubber, butyl rubber or the like, an insulation shield 4, a metal shield layer 5 of a copper wire, a copper tape or the like, and, if necessary, a jacket 6 of a polyvinyl chloride composition or the like are formed in turn in the order named around a conductor 1.

In a power cable of the structure described above, water infiltration may occur either along the conductor or from the outside to the inside of the cable, through the terminal, connecting portions, and/or the outer jacket of the cable for any of a number of reasons arising during manufacture, storage, installation or use of the cable. Water may penetrate from the conductor to the conductor shield and thence to the insulation layer. When AC voltage is applied to a cable installation into which water has been infiltrated in this manner, fine defects called water-trees are formed in the insulation layer and the semiconductive shield. This degrades insulation performance of the cable and may cause an electrical failure.

Methods for preventing water infiltration into the cable insulation or the like may be roughly divided into category (A) methods for preventing water from infiltrating radially into the cable, and category (B) methods for preventing water infiltration along the conductor.

Category (A) methods include (1) a method in which a metal/plastic laminated tape is placed beneath a sheath with the plastic side facing the sheath and the jacket and the plastic layer are bonded together during jacket extrusion so as to form a water impervious layer, and (2) a method in which a watertight compound is introduced beneath the sheath. However, in practice, a satisfactory waterproof effect can not be obtained by these methods.

More specifically, with the method (1), when the jacket has a defect such as a crack, a hole or the like due to either mechanical impact or mishandling during installation, the water impervious layer which is integral with the jacket is also damaged. Then, water enters the cable through the damaged portion and penetrates into the insulation shield or the insulation layer, resulting in unsatisfactory water proofness. With the method (2), the storage life of the watertight compound over a long period of time has not been confirmed. In addition, filling the the gaps between the jacket and the core completely is difficult. For this reason, water infiltration along the longitudinal direction of the cable cannot be satisfactorily prevented. Quality of the power cable cannot be guaranteed.

Category (B) methods include the introduction of a homogeneous mixture of a low-molecular weight polyethylene, microcrystalline wax, polybutene petrolatum, or the like, or a homogeneous mixture of polyvinyl chloride, natural rubber, butyl rubber or the like with a softening agent, as infilling between the stranded wires so as to obtain a watertight construction of stranded conductor. However, a watertight homogeneous compound for filling conductors is generally strongly thixotropic. For this reason, when the wires are stranded, the homogeneous mixture must be troweled while being heated at a high temperature or must be injected under high pressure. Therefore, the mixture becomes scattered around the stranding machine, significantly polluting the working environment. With such a stranding step including the introduction of such a compound, stranding speed is significantly decreased. In addition to these difficulties encountered during manufacture, the filled compound must be completely removed when two cables are to be connected. Connection of cables is thus rendered difficult.

SUMMARY OF THE INVENTION

The present invention has been made in consideration of the problems with conventional rubber or plastic insulated power cables and has for its object to provide an improved rubber or plastic insulated power cable which is impermeable to water.

In a rubber or plastic insulated power cable having a metal shield formed around a cable core consisting of an extruded conductor shield, a rubber or plastic insulation layer, and an extruded insulation shield formed around a conductor, there is provided according to the present invention a water impermeable rubber or plastic insulated power cable wherein first and second water impervious layers each comprising a laminated tape (to be referred to as a water impervious tape hereinafter), each laminated tape being comprised of a lead foil and an electrically conductive rubber or plastic layer formed on at least one surface of the lead foil is formed between the conductor of the cable core and the conductor shield and also between the insulation layer of the cable core and the metal shield layer formed thereover, so that water infiltrates into the cable and cable deterioration due to water-trees or the like may be almost completely prevented over a long period of time, providing excellent long life. Each of said water impervious layers is one of (i) a first laminated tape comprising the lead foil and the electrically conductive rubber or plastic layer formed on one surface of the lead foil; (ii) a second laminated tape comprising the lead foil and an electrically conductive rubber or plastic layer formed on two surfaces of the lead foil; and (iii) a third laminated tape comprising the lead foil, an electrically insulating rubber or plastic layer formed on one surface of the lead foil, and the electrically conductive rubber or plastic layer formed on the other surface of the lead foil.

The following various effects are obtained from power cables of the present invention having this construction.

(1) Water in the stranded conductor or outside the cable is prevented for a long time from infiltrating into the insulation layer.

(2) Since the lead foil tape, which is part of the water impervious layer, can be easily grounded, an irregular voltage, even when caused, does not damage the lead foil tape and make it lose its effects.

(3) Even in case the water impervious layer is partly punctured for some reason or other, the integral construction of the cable core and water impervious layer locally limits water infiltration through the puncture and prevents it from spreading in the longitudinal direction of the cable.

(4) The lead foil tape of the water impervious layer is reinforced with plastics or rubber and this layer is provided in a closely integral unit with the cable core. It therefore excels in mechanical strength against cable bending and external pressure.

(5) The water impervious layer using lead is highly resistant to water and chemicals.

(6) The water impervious layer is provided on the conductor with a conductive tape applied in between and is therefore not liable to damage by high-pressure extrusion of the insulation.

(7) In the case of crosslinked polyethylene insulation, a useful product of crosslinking reaction, such as acetophenone can be kept in the insulation for a long time by the water impervious layer. Therefore an effect of maintaining the dielectric strength can be expected.

DETAILED DESCRIPTION OF THE PREFERRED EMBODIMENTS

Figure 1:
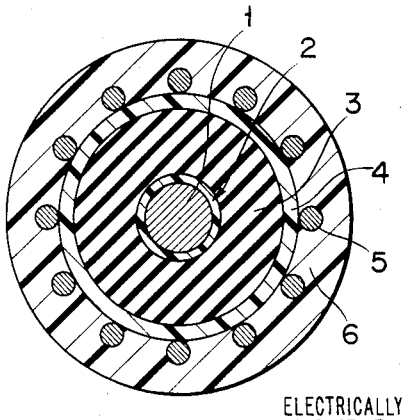
FIG. 1 (PRIOR ART)
FIG. 1 is a sectional view showing an example of a conventional cable construction.

The present invention will now be described with reference to FIGS. 2 and 3. When a power cable of the present invention is manufactured, a water impervious tape (a first or second laminated tape), comprised of a lead foil and an electrically conductive rubber or plastic layer formed on at least one surface of the lead foil, is longitudinally coated over a conductor 1 to form a water impervious layer *7a*. Subsequently, a conductor shield 2, an insulation layer 3 and an insulation shield 4 are sequentially or simultaneously extruded thereon. The water impervious tape *7a* (see FIG. 4) and *7b* (see FIG. 5) comprising a thin lead foil layer 17 and at least one rubber or plastic layer 18, 19 has a low mechanical strength. Therefore, when the extrusion of these subsequent layers is performed at a temperature of 150° to 250° C. and a pressure of 3 to 30 kg/cm$^2$, the tape may be pressed into a gap between wires of the conductor 1 and the lead foil layer may break at such a portion. In order to prevent this, it is preferable to wind an electrically conductive tape around the conductor 1 to form an electrically conductive tape layer *8a*, and then to longitudinally apply the water impervious tape to form the water impervious layer *7a* thereafter, so that the electrically conductive tape layer *8a* may serve as a support layer for the water impervious layer *7a*.

Figure 2:
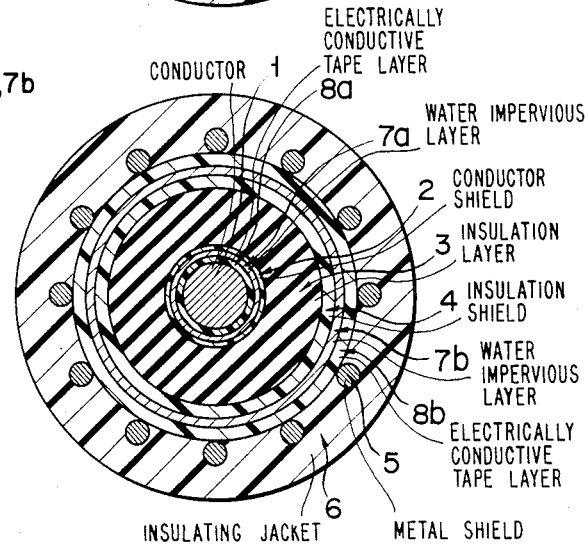
FIG. 2 is a sectional view showing an example of a cable construction according to the present invention.
Figure 3:
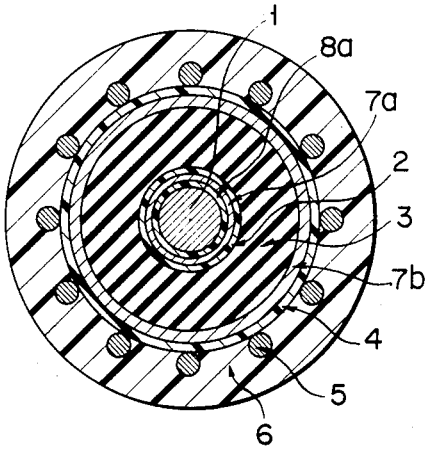
FIG. 3 is a sectional view showing another example of a cable construction according to the present invention.

A water impervious layer *7b* to be formed between the insulation layer 3 and a metal shield 5 may be formed either on the insulation layer 3 (FIG. 3) or on the extruded insulation shield 4 (FIG. 2).

Figure 5:
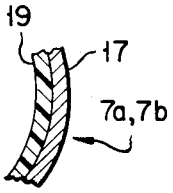
FIG. 5 shows an enlarged fragmentary cross-section of an alternate water impervious tape used in the present invention.
Figure 4:
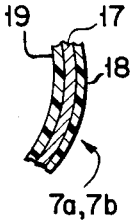
FIG. 4 shows an enlarged fragmentary cross-section of a water impervious tape used in the present invention.

When the water impervious layer *7b* (the first or second laminated tape) is formed on the extruded insulation shield 4 (FIG. 2), the rubber or plastic layer 18 formed on at least one surface of the lead foil 17 must be electrically conductive. Layer *7b* may be constructed as shown in FIG. 4. Layers *7a* and *7b* may alternately be constructed as shown in FIG. 5, wherein layer 17 is a thin lead foil layer, and layer 19 is an electrically conductive layer formed of rubber or plastic material. Furthermore, the electrically conductive rubber or plastic layer 18 of the water impervious tape must face the extruded insulation shield 4 and be adhered thereto.

When the water impervious layer *7b* is formed on the extruded insulation shield 4, if the metal shield layer 5 is formed directly on the water impervious layer *7b*, the water impervious tape between the extruded insulation shield 4 and the metal shield layer 5 is subject to mechanical fatigue, and may eventually be damaged by winding on or unwinding from a reel during the manufacture of the cable or by the heat cycle of the power load after cable installation. When the power cable is mechanically distorted by bending or stretching, the extruded insulation shield 4 and the water impervious layer *7b* may separate. Then, partial discharge or an increase in the dielectric loss tangent tanδ of the cable may be caused at such a separated portion.

In order to prevent these problems, it is preferable to first longitudinally apply the water impervious tape (the first or second laminated tape) on the extruded insulation shield 4 to form the water impervious layer *7b* and then to wind thereover an electrically conductive tape comprised of a resin having a melting point of 150° C. or higher as a base so as to form an electrically conductive tape layer *8b* and to form the water impervious layer *7b* and the extruded insulation shield 4 integral with each other.

A power cable of such a construction will be free from the problems described above and will maintain excellent characteristics even after it is subjected to mechanical and thermal distortion.

When the resin as the base of the electrically conductive tape has a melting point below 150° C., it will develop heat deterioration under the operating conditions (long-time heat resistance 90° C., short-time heat resistance 105° C.).

Although there are various resins which have a melting point of 150° C. or higher, polyester, polypropylene, polyamide and the like may be preferably used from the viewpoint of mechanical and thermal characteristics and economy. These resins may be used singly or in admixture.

In order to obtain an electrically conductive tape from such a resin or resins, the tape is obtained from the resin or resins with the addition of a suitable amount of carbon black. Alternatively, a base fabric is obtained from the resin or resins without the addition of the carbon black, and an electrically conductive homogeneous compound is coated on the base fabric.

The electrically conductive tape preferably has a thickness of 100 μm or more. If the electrically conductive tape has a thickness smaller than this lower limit, adhesion between the extruded insulation shield 4 and the water impervious layer *7b* is degraded at high temperatures.

On the other hand, when the water impervious layer *7b* is formed directly on the insulation layer 3 (FIG. 3), a water impervious tape (the second laminated tape) comprised of a lead foil and electrically conductive rubber or plastic layers formed on the two surfaces of the lead foil may be adhered on the insulation layer 3. Alternatively, a water impervious tape (a third laminated tape) comprised of a lead foil, an electrically insulating rubber or plastic layer formed on one surface of the lead foil, and an electrically conductive rubber or plastic layer formed on the other surface of the lead foil, is adhered on the insulation layer 3 so that the electrically insulating rubber or plastic layer of the tape faces the insulation layer 3. Then, the insulation shield 4 may be formed thereover by extrusion.

The lead foil is used as a metal component of the water impervious tape for the following reasons. For example, lead is superior in water impermeability and chemical resistance compared to aluminum, copper and stainless steel. Aluminum and stainless steel corrode through contact with the electrically conductive carbon black in the electrically conductive composition in the presence of water. Therefore, aluminum and stainless steel fail to provide water impermeability and chemical resistance over a long period of time.

The base material of the electrically conductive or electrically insulating rubber or plastic layer laminated on the lead foil may be one of or a mixture of two or more of the following materials: low, medium and high density polyethylene, polypropylene, polybutene-1, polymethyl pentene, ethylene-propylene copolymer, ionomer, ethylene-ethylacrylate copolymer, ethylene-vinyl acetate-vinyl chloride graft copolymer, chlorinated polyethylene, chlorosulfonated polyethylene, ethylene-acrylic acid copolymer, isoprene rubber, chloroprene rubber, acrylonitrile-butadiene rubber, styrene-butadiene rubber.

The electrically conductive rubber or plastic layer must have a resistivity of $10^7\Omega\cdot$cm or less. Such a layer may be made of a homogeneous compound obtained by adding an electrically conductive rendering agent such as carbon black to the base material as described above, or may comprise a combination of electrically conductive base fabrics obtained by coating an electrically conductive homogeneous mixture to the fibrous material of the base material described above.

The electrically conductive rendering agent is preferably carbon black. Although no special requirements are given for the carbon black which may be used, KETJEN BLACK EC (trade name of carbon black manufactured by AKZO CO., LTD.) is preferable since it can provide a high conductivity when added in a small amount.

According to the present invention, the electrically conductive rubber or plastic layer of the water impervious layer must have a resistivity of $10^7\Omega\cdot$cm or less. When the resistivity exceeds $10^7\Omega\cdot$cm, small voids or gaps between the extruded insulation shield 4 and the water impervious layer *7b* may cause partial discharge or an increase in the dielectric loss tangent $\tan\delta$, thus degrading the cable characteristics. Such problems rarely occur if the resistivity is $10^7\Omega\cdot$cm or less.

The insulation layer of the power cable of the present invention preferably consists of an electrically insulating composition selected from crosslinked polyethylene composition, polyethylene composition, ethylene-propylene rubber composition, or butyl rubber composition. The metal shield may conveniently consist of a metallic material selected from a copper tape, an aluminum tape, a copper wire, and an aluminum wire. An anticorrosive plastic jacket 6 is generally formed on the metal shield. The anticorrosive plastic jacket 6 preferably consists of an electrically conductive composition rather than an electrically nonconductive composition.

If the anticorrosive plastic jacket 6 is electrically conductive, the power cable may be directly buried underground to be earthed at any longitudinal portion, so that the cable may not present any problem to a communication cable nearby. In this case, the electrically conductive plastic jacket preferably has a resistivity of $10^7\Omega\cdot$cm or less.

EXAMPLE 1

One layer of a conductive tape of 0.1 mm thickness consisting of a nylon cloth as a support and a conductive compound coated on its two surfaces was lap-wound with a ½ lap around a conductor consisting of 19 stranded aluminum wires each having 1.9 mm diameter. A water impervious tape (the second laminated tape) was then prepared by coating a conductive polymer to a thickness of 0.1 mm on each surface of a lead foil 0.05 mm thick. The conductive polymer was obtained by mixing a conductive carbon with an ethylene-acrylic acid copolymer (EAA). The water impervious tape thus obtained was longitudinally laid on the nylon cloth conductive layer. A conductor shield, an insulation layer of polyethylene, and an insulation shield were simultaneously extruded thereover. The conductor shield was made of a conductive composition which consisted of a conductive carbon with a base polymer consisting of ethylene-ethylacrylate copolymer (EEA) and low density polyethylene (PE). The insulation shield was made of the same conductive composition as that for the conductor shield. After longitudinally laying a water impervious tape (the second laminated tape) of the same structure as that lapped on the conductor on the insulation shield, one layer of a conductive tape 0.25 mm thick was wound ½ lap. The conductive tape was obtained by topping a nylon base fabric with conductive rubber. The resultant cable core was heated to firmly adhere the lap portion of the water impervious tape and to make the water impervious tape and the insulation shield integral with each other. A tin-plated copper wire having 1.6 mm diameter was spirally wound on the cable core thus obtained.

A conductive material obtained by mixing a conductive carbon with PE was extruded as an anticorrosive jacket on the wound tin-plated copper wire of 1/0 AWG to provide a 15 KV cable.

The following experiment was also made.

The cable made in Example 1 was given a 20 mm-diameter hole reaching the water impervious layer from the jacket. (The insulation shield was left unharmed.) The cable was then bent five times, in one way and back each time, around a mandrel having a diameter equal to ten times the cable diameter, put in a hot water bath heated to 70° C. and, with its conductor filled with water, given an AC voltage of 15 KV for about one month. After one month of such voltage application under the water-immersed condition, the cable was examined for the water content of the insulation shield and for bow-tie trees in the insulation. The results are shown in the Table 1 below.

TABLE 1

| Location of measurement | Water content of insulation shield (%) | Bow-tie tree in insulation (50μ or longer) |
|---|---|---|
| (a) Immediately below the hole | 5.4 | Observed |
| (b) 30 cm away from | 0.4 | Not observed |

TABLE 1-continued

| Location of measurement | Water content of insulation shield (%) | Bow-tie tree in insulation (50μ or longer) |
|---|---|---|
| the hole | | |

As is evident from the above table, it was ascertained in the cable of this construction that even in case a defect such as a pinhole or crack is caused to the water impervious layer, water infiltration through the defect is locally confined (within 30 cm from the defect in the above example) and does not run in the longitudinal direction of the cable because the water impervious layer is provided in a close integral unit with the cable core.

EXAMPLE 2

One layer of a conductive tape 0.1 mm thick consisting of a "Tetoron" cloth as a support and an electrically conductive compound coated on its two surfaces was wound with a ½ lap on an aluminum conductor which was the same as that used in Example 1. A water impervious tape (the second laminated tape) was prepared by coating a conductive polymer on each surface of a 0.03 mm thick lead foil to a thickness of 0.05 mm. The conductive polymer was obtained by mixing a conductive carbon with a mixture of EAA and PE. The water impervious tape thus obtained was longitudinally wound on the conductive Tetron tape. A conductor shield, an insulation layer of crosslinked polyethylene, and an insulation shield were simultaneously extruded thereover. Both the conductor and insulation shield were made of a conductive composition consisting of an ethylene-propylene rubber as a base polymer and a conductive carbon. After longitudinally laying a water impervious tape (the second laminated tape) of the same construction as that laid on the conductor on the insulation shield, two layers of a conductive tape of 0.25 mm thickness obtained by topping a "Tetoron" base fabric with a conductive rubber were wound ½ lap. The resultant cable core was heated to securely adhere the lap portion of the water impervious tape and to make the water impervious tape and the insulation shield integral with each other.

An aluminum wire of 1.6 mm diameter was spirally wound on the thus obtained cable core. A conductive layer obtained by mixing a conductive carbon to polyvinyl chloride was extruded thereover to form a jacket. A 15 KV cable having an Al conductor of 1/0 AWG was thus obtained.

EXAMPLE 3

One layer of a conductive tape of 0.1 mm thickness and consisting of a polypropylene cloth as a support and a conductive compound coated on its two surfaces was wound ¼ lap on a conductor consisting of 19 stranded aluminum wires each having a diameter of 1.9 mm. A water impervious tape (the second laminated tape) consisting of a lead foil and conductive vinyl films 0.1 mm thick adhered on the two surfaces of the lead foil through a conductive adhesive was longitudinally laid on the conductor with the conductive tape applied in between. A conductor shield, an insulation layer of an ethylene-propylene rubber, and an insulation shield were simultaneously extruded thereover. The conductor and insulation shield were made of a conductive composition obtained by mixing a conductive carbon to a base polymer consisting of EEA and PE. A water impervious tape (the second laminated tape) was obtained by forming a layer 0.05 mm thick, on each surface of a lead foil 0.05 mm thick, of a conductive polymer consisting of a conductive carbon and EAA. The water impervious tape was longitudinally laid on the insulation shield. One layer of a conductive tape of 0.10 mm thickness obtained by coating a conductive rubber on a "Tetoron" base fabric was wound ½ lap. The resultant cable core was heated to securely adhere the lap portion of the water impervious tape and to make the water impervious tape and the insulation shield integral with each other.

A metal shield was formed from a copper tape of 0.1 mm thickness on the conductive tape of the cable core. The conductive composition which is the same as that used for both the conductor and insulation shield were extruded to form an anticorrosive jacket, thus preparing a 15 KV cable having an Al conductor of 1/0 AWG.

EXAMPLE 4

After following the same procedures as those in Example 1 up to formation of a conductor shield and an insulation layer by extrusion, a water impervious tape was longitudinally laid on the insulation. The water impervious tape (the second laminated tape) was obtained by forming a layer 0.05 mm thick, on each surface of a lead foil 0.05 mm thick, of a conductive polymer consisting of a conductive carbon and EAA. After heating the lap portion to securely adhere it, a conductive composition the same as that used for the conductor shield was extruded thereover to form an insulation shield, thereby making the water impervious tape integral with the insulation layer and the insulation shield.

After spirally winding a copper wire of 1.6 mm diameter around the cable core thus obtained, a conductive material obtained by mixing a conductive carbon to PE was extruded as a jacket. A 15 KV cable having an Al conductor of 1/0 AWG was thus prepared.

EXAMPLE 5

The same procedures as in Example 1 were followed except that a stranded wire conductor was obtained by compressing an aluminum conductor consisting of 19 aluminum wires each having a 1.9 mm diameter to a space factor of 85%, and that the conductive tape was not lap-wound but the water impervious tape (the second laminated tape) was directly and longitudinally laid on the conductor. A 15 KV cable having an Al conductor of 1/0 AWG was thus prepared.

EXAMPLE 6

The same procedures as in Example 1 were followed except that after spirally winding a tin-plated copper wire of 1.6 mm diameter on the cable core, two layers of a nylon unwoven fabric 0.1 mm thick were wound thereover ½ lap, and a jacket of polyvinyl chloride was extruded thereover. A 15 KV cable having an Al conductor of 1/0 AWG was prepared.

EXAMPLE 7

After forming a conductive tape layer, a water impervious tape layer, a conductor shield and an insulation layer of polyethylene on an aluminum conductor consisting of 19 stranded wires each having a diameter of 1.9 mm in the same manner in Example 1 above, a water impervious tape was longitudinally laid on the insulation layer such that a PE layer of a water impervious tape faced the insulation layer. The water impervious tape (the third laminated tape) was obtained by forming the 0.10 mm PE layer on one surface of a lead foil 0.05 mm thick and forming a layer of a conductive polymer consisting of an ionomer resin and a conductive carbon on the other surface of the lead foil to a thickness of 0.10 mm. After the lap portion was heated for better adhesion strength, the same conductive composition as that used for the conductor shield composition was extruded to form an insulation shield, thereby making the water impervious tape, the insulation layer and the insulation shield integral with each other.

After spirally winding a copper wire of 1.6 mm diameter on the cable core thus obtained, a conductive material consisting of PE and a conductive carbon was extruded to form a jacket. A 15 KV cable having an Al conductor of 1/0 AWG was prepared.

COMPARATIVE EXAMPLE 1

A conductor shield, an insulation layer of polyethylene, and an insulation shield were simultaneously extruded on a conductor consisting of 19 stranded aluminum wires each having a diameter of 1.9 mm. Both the conductor and insulation shield were made of a conductive composition which was obtained by mixing a conductive carbon to a base polymer consisting of EEA and PE. Thereafter, a water impervious tape was longitudinally laid around the insulation shield. The water impervious tape (the second laminated tape) was obtained by coating, on each surface of a lead foil 0.03 mm thick, to a thickness of 0.10 mm a conductive polymer which was, in turn, obtained by mixing a conductive carbon to a mixture of EAA and PE. After winding ½ lap one layer of a conductive tape 0.1 mm thick which was obtained by coating a "Tetoron" base fabric with a conductive rubber, the resultant cable core was heated to securely adhere the lap portion and to make the water impervious tape and the insulation shield integral with each other.

After spirally winding an aluminum wire of 1.6 mm diameter on the cable core, a conductive material consisting of polyvinyl chloride with a conductive carbon was extruded to form a jacket. A 15 KV cable having an Al conductor of 1/0 AWG was prepared.

COMPARATIVE EXAMPLE 2

One layer of a 0.1 mm-thick conductive tape which was obtained by coating each surface of a "Tetoron" cloth as a support with a conductive compound was wound ¼ lap on a conductor consisting of 19 stranded aluminum wires each having a diameter of 1.9 mm. A water impervious tape was then longitudinally laid on the conductive Tetron tape. The water impervious tape (the second laminated tape) was prepared by coating a conductive polymer consisting of EAA and a conductive carbon to a thickness of 0.1 mm on each surface of a lead foil 0.05 mm thick. A conductor shield, an insulation layer of crosslinked polyethylene, and an insulation shield were simultaneously extruded thereover. Both the conductor and insulation shield were made of a conductive composition consisting of an ethylene-propylene rubber as a base polymer and a conductive carbon. After spirally winding an aluminum wire of 1.6 mm diameter around the cable core thus obtained, the conductive polyethylene composition was extruded as a jacket. A 15 KV cable having an Al conductor of 1/0 AWG was prepared.

COMPARATIVE EXAMPLE 3

A conductor shield, an insulation layer of crosslinked polyethylene, and an insulation shield were simultaneously extruded on an aluminum conductor consisting of 19 stranded wires each having a diameter of 1.9 mm. Both the conductor and insulation shield were made of a conductive composition which was obtained by mixing a conductive carbon to a base polymer consisting of EEA and PE. After spirally winding a tin-plated copper wire of 1.6 mm diameter on the thus obtained cable core, two layers of a nylon unwoven fabric 0.1 mm thick were wound ½ lap and a water impervious tape was longitudinally laid thereover. The water impervious tape (the second laminated tape) was obtained by coating each surface of a lead foil 0.05 mm thick with a conductive polymer consisting of EAA and a conductive carbon to a thickness of 0.1 mm. After heating for better adhesive strength of the lap portion, the same conductive composition as that used for the conductor and insulation shield was extruded to form a jacket. A 15 KV cable having an Al conductor of 1/0 AWG was prepared.

COMPARATIVE EXAMPLE 4

A 15 KV cable having an Al conductor of 1/0 AWG was prepared in the same manner as in Example 1 except that the metal foil of the water impervious tape was an aluminum foil tape 0.05 mm thick in place of the lead foil tape.

COMPARATIVE EXAMPLE 5

A 15 KV cable having an Al conductor of 1/0 AWG was prepared in the same manner as in Example 1 except that the metal foil of the water impervious tape was a copper foil 0.02 mm thick in place of the lead.

The respective cables prepared in Examples 1 to 7 and Comparative Examples 1 to 5 were measured for their initial water content and initial AC breakdown voltage. Thereafter, each cable was bent five times in the two opposite directions along a mandrel having a diameter which was 10 times the outer diameter of each cable. The cable was then immersed in a water thermostat kept at 70° C. An AC voltage of 15 KV was applied to the cable. And the gap of the conductor strands was filled with water during the voltage application. AC voltage application was kept for one year under this condition.

After one year, each cable was examined for its AC breakdown voltage, the water content in the insulation, the presence of the bow-tie trees in the insulation, and the state of the metal of the water impervious layer. The obtained results are shown in Table 2 below.

TABLE 2

Test Results After Immersion in 70° C. Water for One Year

| | Insulation initial water | Water content after immer- | Bow-tie tree (50μ long or longer) in insulation after immer- | Initial AC breakdown voltage | AC breakdown voltage after immer- | State of metal of the water impervious layer after |
|---|---|---|---|---|---|---|

TABLE 2-continued

| Test Results After Immersion in 70° C. Water for One Year | | | | | | |
|---|---|---|---|---|---|---|
| | content (%) | sion (%) | sion | (KV) | sion (KV) | immersion |
| Example 1 | <0.01 | <0.01 | Not observed | 250 | 245 | Excellent; no pinholes in Pb |
| Example 2 | <0.01 | <0.01 | Not observed | 230 | 230 | Excellent; no pinholes in Pb |
| Example 3 | <0.01 | <0.01 | Not determinable | 210 | 220 | Excellent; no pinholes in Pb |
| Example 4 | <0.01 | <0.01 | Not observed | 220 | 225 | Excellent; no pinholes in Pb |
| Example 5 | <0.01 | <0.01 | Not observed | 230 | 235 | Excellent; no pinholes in Pb |
| Example 6 | <0.01 | <0.01 | Not observed | 225 | 230 | Excellent; no pinholes in Pb |
| Example 7 | <0.01 | <0.01 | Not observed | 230 | 210 | Excellent; no pinholes in Pb |
| | Insulation initial water content (%) | Water content after immersion (%) | Bow-tie tree (50μ long or longer) in insulation after immersion | Initial AC breakdown voltage (KV) | AC breakdown voltage after immersion (KV) | State of metal sheath after immersion |
| Comparative Example 1 | <0.01 | 0.03~0.05 | Observed | 250 | 150 | Excellent; no pinholes in Pb |
| Comparative Example 2 | <0.01 | 0.05~0.07 | Observed | 240 | 125 | Excellent; no pinholes in Pb |
| Comparative Example 3 | <0.01 | 0.1~0.15 | Observed | 235 | 165 | Excellent; no pinholes in Pb |
| Comparative Example 4 | <0.01 | 0.1~0.2 | Observed | 245 | 170 | Pinholes and cracks in Al |
| Comparative Example 5 | <0.01 | 0.04~0.06 | Observed | 240 | 155 | Corrosion and cracks in Cu |

*Each cable was subjected to load testing after being bent five times in each of two opposite directions around a mandrel having a diameter equal to 10 times the outer diameter of the cable.

As may be seen from the Table 2 above, in the cables of Examples 1 to 7, no change was observed for the water impervious layer on the conductor and that on the insulation, no bow-tie trees were observed in the insulation, and the water content of the insulation was less than 0.01% which was the same before the test.

In contrast to this, in the cables of the comparative examples, a number of bow-tie trees were observed in the insulation, and the water content in the insulation was as great as 0.03 to 0.2%. This indicates that water had infiltrated into the insulation from the side of the conductor and/or through the outer surface of the cable.

In Comparative Examples 4 and 5, although water impervious layers are formed on the conductor and the insulation layer, a number of bow-tie trees were observed in the insulation. An examination of the cable revealed many pinholes in the Al used as the metal foil of the water impervious tape. These pinholes were presumed to have been formed by electrical corrosion between the conductive carbon and Al in the presence of water. Water must have infiltrated into the insulation layer through these pinholes or cracks in the cables of Comparative Examples 4 and 5.

What is claimed is:

1. In an insulated power cable having a cable core comprising a conductor; an extruded conductor shield; an insulation layer selected from the group consisting of cross-linked polyethylene composition, polyethylene composition and ethylene-propylene rubber composition; and an extruded insulation shield; the last three members being sequentially formed around the conductor; and a metal shield layer formed around the cable core;

the improvement comprising:

a supporting layer of an electrically conductive tape layer wound directly around the conductor of the cable core; and inner and outer water impervious layers, each comprising a laminated tape;

the inner water impervious layer comprising a lead foil layer and an electrically conductive plastic layer formed on at least one surface of the lead foil layer, the inner water impervious layer being longitudinally applied to a region around the conductor of the cable core and over said supporting layer, and said inner water impervious layer being arranged underneath and bonded to the conductor shield of the cable core; and the outer water impervious layer comprising a lead foil layer and additional layers laminated on both surfaces of the lead foil layer, at least one of said additional layers of the outer water impervious layer being an electrically conductive plastic layer, the outer water impervious layer being positioned between the insulation layer of the cable core and the metal shield layer, and the outer water impervious layer being longitudinally applied to a region directly above the cable core and being bonded to the cable core.

2. A power cable according to claim 1, wherein the metal shield layer consists essentially of a metallic material selected from the group consisting of a copper tape, an aluminum tape, a copper wire and an aluminum wire.

3. A power cable according to claim 1, wherein a plastic jacket is formed on the metal shield layer.

4. A power cable according to claim 3, wherein the plastic jacket consists essentially of an electrically conductive plastic composition.

5. A power cable according to claim 1, wherein at least one of said inner and outer water impervious layers comprises an electrically conductive plastic layer on both opposite surfaces of its associated lead foil layer.

6. A power cable according to claim 1, wherein at least one of said inner and outer water impervious layers comprises an electrically insulating layer on one surface of its associated lead foil layer, said electrically insulating layer being selected from the group consisting of an electrically insulating rubber layer and an electrically insulating plastic layer, said electrically conductive plastic layer being formed on the other surface of said associated lead foil layer.

7. A power cable according to claim 5, wherein at least said outer water impervious layer comprises electrically conductive plastic layers on both opposite surfaces of said lead foil layer, and said outer water impervious layer being formed over and bonded with said extruded insulation shield of said cable core.

8. A power cable according to claim 1, wherein said outer water impervious layer comprises said electrically conductive plastic layer formed on only one surface of said lead foil layer, said electrically conductive plastic layer of said outer water impervious layer faces said extruded insulation shield of said cable core, and further comprising an electrically conductive tape layer consisting essentially of a resin having a melting point of not lower than 150° C. as a base formed around the outer water impervious layer.

9. A power cable according to claim 5, wherein said inner water impervious layer comprises electrically conductive plastic layers on both opposite surfaces of said lead foil layer, and wherein said inner water impervious layer is formed by longitudinal application thereof over a region around said conductor of said cable core and over said supporting layer.

10. A power cable according to claim 1, wherein said inner water impervious layer comprises said electrcially conductive plastic layer formed only on one surface of said lead foil layer, and wherein said inner water impervious layer is formed by longitudinal application thereof over a region said conductor of said cable core and over said supporting layer so that said electrically conductive plastic layer of said inner water impervious layer faces said conductor shield of said cable core, said electrically conductive plastic layer of said inner water impervious layer being bonded with said conductor of said cable core.

11. A power cable according to claim 6, wherein said electrically insulating layer of said outer water impervious layer consists essentially of at least one material selected from the group consisting of low, medium and high density polyethylene, polypropylene, polybutene-1, polymethyl pentene, ethylene-propylene copolymer, ionomer, ethylene-ethylacrylate copolymer, ethylene-vinyl acetate-vinyl chloride graft copolymer, chlorinated polyethylene, chlorosulfonated polyethylene, ethylene-acrylic acid copolymer, isoprene rubber, chloroprene rubber, acrylonitrile-butadiene rubber, and styrene-butadine rubber.

12. A power cable according to claim 1, wherein said electrically conductive plastic layer of at least one of said inner and outer water impervious layers has a resistivity of $10^7\Omega\cdot$cm or less and is made of a homogeneous compound obtained by adding an electrically conductive rendering agent to at least one base material selected from the group consisting of low, medium and high density polyethylene, polypropylene, polybutene-1, polymethyl pentene, ethylene-propylene copolymer, ionomer, ethylene-ethylacrylate copolymer, ethylene-vinyl acetate-vinyl chloride graft copolymer, chlorinated polyethylene, chlorosulfonated polyethylene, ethylene-acrylic acid copolymer, isoprene rubber, chloroprene rubber, acrylonitrile-butadiene rubber, and styrene-butadine rubber.

13. In an insulated power cable core comprising a conductor; an extruded conductor shield; an insulation layer selected from the group consisting of cross-linked polyethylene composition, polyethylene composition and ethylene-propylene rubber composition; and an extruded insulation shield; the last three members being sequentially formed around the conductor; and a metal shield layer formed around the cable core;

the improvement comprising:

a supporting layer of an electrically conductive tape layer wound directly around the conductor of the cable core; and inner and outer water impervious layers, each comprising a laminated tape;

the inner water impervious layer comprising a lead foil layer and an electrically conductive plastic layer formed on at least one surface of the lead foil layer, the inner water impervious layer being longitudinally applied to a region around the conductor of the cable core and over said supporting layer, and said inner water impervious layer being arranged underneath and bonded to the conductor shield of the cable core; and the outer water impervious layer comprising a lead foil layer and electrically conductive plastic layers laminated on both opposite surfaces of the lead foil layer, the outer water impervious layer being positioned between the insulation layer of the cable core and the metal shield layer, and the outer water impervious layer bding formed by longitudinal application thereof over said insulation layer of the cable core and being bonded with said insulation layer and said extruded insulation shield of the cable core.

14. In an insulated power cable core comprising a conductor; an extruded conductor shield; an insulation layer selected from the group consisting of cross-linked polyethylene composition, polyethylene compositionand ethylene-propylene rubber composition; and an extruded insulation shield; the last three members being sequentially formed around the conductor; and a metal shield layer formed around the cable core;

the improvement comprising:

a supporting layer of an electrically conductive tape layer wound directly around the conductor of the cable core; and inner and outer water impervious layers, each comprising a laminated tape;

the inner water impervious layer comprising a lead foil layer and an eIectrically conductive plastic layer formed on at least one surface of the lead foil layer, the inner water impervious layer being longitudinally applied to a region around the conductor of the cable core and over said suppporting layer, and said inner water impervious layer being arranged underneath and bonded to the conductor shield of the cable core;

the outer water impervious layer comprising a lead foil layer, an electrically conductive plastic layer formed on only one surface of the lead foil layer, and an electrically insulating layer formed on the opposite surface of the lead foil layer, the outer water impervious layer being positioned between the insulation layer of the cable core and the metal shield layer, and the outer water impervious layer being formed by longitudinal application thereof over said insulation layer of the cable core, said electrically insulating layer of said outer water impervious layer being bonded with said insulation layer of the cable core, and said electrically conductive plastic layer of said outer water impervious layer being bonded with said extruded insulation shield of the cable core; and said electrically insulating layer of said outer water impervious layer being selected from the group consisting of an electrically insulating rubber layer and an electrically insulating plastic layer.

* * * * *